US006190163B1

(12) United States Patent
Maricic et al.

(10) Patent No.: US 6,190,163 B1
(45) Date of Patent: Feb. 20, 2001

(54) BURNER NOZZLE

(75) Inventors: Richard Maricic, Parma; Thomas F. Hutchinson, Jr., Lorain, both of OH (US)

(73) Assignee: Beckett Gas, Inc., N. Ridgeville, OH (US)

( * ) Notice: Under 35 U.S.C. 154(b), the term of this patent shall be extended for 0 days.

(21) Appl. No.: 09/257,160

(22) Filed: Feb. 24, 1999

Related U.S. Application Data

(60) Provisional application No. 60/075,730, filed on Feb. 24, 1998.

(51) Int. Cl.[7] ..... F23D 14/62

(52) U.S. Cl. ..... 431/354; 431/353; 431/286; 239/556

(58) Field of Search ..... 431/286, 350, 431/353, 354; 239/556, 567, 568

(56) References Cited

U.S. PATENT DOCUMENTS

| | | | | |
|---|---|---|---|---|
| 891,245 | * | 6/1908 | Gruyink | 239/563 |
| 1,077,073 | * | 10/1913 | Hook | 239/556 |
| 1,424,739 | | 8/1922 | Reeves . | |
| 2,318,769 | * | 5/1943 | Freeman et al. | 239/556 |
| 2,357,647 | * | 9/1944 | Greene | 239/568 |
| 2,818,059 | * | 12/1957 | Cayot | 126/110 R |
| 2,896,703 | | 7/1959 | Weber . | |
| 2,985,233 | * | 5/1961 | Stellmach | 239/556 |
| 3,092,169 | | 6/1963 | Lohman . | |
| 3,198,238 | | 8/1965 | Hughes . | |
| 3,285,318 | | 11/1966 | Keinonen et al. . | |
| 3,391,982 | * | 7/1968 | Ward | 431/286 |
| 3,592,577 | | 7/1971 | Kofink . | |
| 3,830,620 | * | 8/1974 | Martin | 431/350 |
| 4,251,205 | | 2/1981 | Roeder et al. . | |
| 4,416,613 | | 11/1983 | Barisoff . | |
| 4,418,456 | * | 12/1983 | Riehl | 431/354 |
| 4,631,023 | * | 12/1986 | Courrege | 431/354 |
| 4,895,514 | * | 1/1990 | Cantryn et al. | 431/350 |
| 5,186,620 | | 2/1993 | Hollingshead . | |
| 5,255,854 | * | 10/1993 | Keim et al. | 239/568 |
| 5,406,703 | | 4/1995 | Haen et al. . | |
| 5,647,739 | | 7/1997 | McDonald . | |
| 5,649,821 | * | 7/1997 | Fogliani et al. | 431/354 |

FOREIGN PATENT DOCUMENTS

| | | | | |
|---|---|---|---|---|
| 242304 | * | 7/1960 | (AU) | 239/568 |

* cited by examiner

*Primary Examiner*—Ira S. Lazarus
*Assistant Examiner*—Josiah C. Cocks
(74) *Attorney, Agent, or Firm*—Watts, Hoffman, Fisher & Heinke Co., LPA

(57) ABSTRACT

A burner nozzle includes a burner tube that extends along a central axis and has an inlet end portion for receiving combustible gas and air. At least one body or chamber has a passageway in communication with the burner tube along the central axis which leads to an elongated outlet end portion. At least one flame-shaping opening is located adjacent the outlet end portion. Each flame-shaping opening may be constructed and arranged effective to elongate (broaden the width of) flame resulting from combustion of the mixture transverse to the central axis to produce efficient heat transfer between the flame and air inside a heat-receiving member disposed downstream of the outlet opening. A flame length reducing member may be used instead of or in addition to the flame-shaping opening and the flame shaping opening may itself reduce flame length. A burner assembly may include a combustion tube in which the burner nozzle is disposed and connected. The burner nozzle is used in a method for broadening and shaping the flame.

10 Claims, 6 Drawing Sheets

BURNER NOZZLE

This application claims benefit to U.S. provisional application Ser. No. 60/075,730, filed Feb. 24, 1998.

FIELD OF INVENTION

This invention relates to burners and, more specifically, to gas burners suitable for use in appliances and the like.

BACKGROUND OF THE INVENTION

Burners are used, for example, in apparatuses including furnaces and appliances such as clothes dryers. A principle component of burners is a nozzle typically in the form of a venturi tube. Combustible gas is fed into the nozzle and entrains air into the nozzle. The air and gas is mixed in the venturi and the mixture emerges from the outlet end. An igniter may be attached directly to the venturi tube in front of the outlet opening in alignment with a longitudinal axis along which the nozzle extends and ignites the mixture as it leaves the outlet, thereby creating flame which produces heat that is utilized by the apparatus.

In furnaces, a plurality of burner nozzles are typically arranged side-by-side and are designed for cross-ignition of the gas in adjacent nozzles. One conventional nozzle has two plenum chambers located at an outlet end of the venturi tube. Each plenum chamber has a thin outlet slit along its side edges. Flame released from the side outlet slits of one nozzle ignites gas from an adjacent nozzle.

Clothes dryer burners may be horizontally fired into ducts of the dryer. The ducts shield the open flame and force the heated gases in the desired direction. The burner may include an attachment known as a flame spreader which is separately formed from the nozzle, mounted such as by welding to the nozzle and axially spaced from the outlet opening of the nozzle. Flame spreaders shorten and spread out the flame transverse to a direction of gas flow. The flame spreaders are disposed in the flame and thus, are exposed to relatively high temperatures. This requires the flame spreaders to be fabricated from metals which can withstand this high temperature environment.

Conventional gas dryer burner nozzles typically produce flame having a length of, for example, about one foot. However, space is limited in the dryer. Long flame lengths may result in inefficient heat transfer between the flame and air inside the ductwork, overheating of the ductwork, or an increase in the cost of the dryer due to the use of enough ductwork and other components to accommodate the long flame. Heated gases from the horizontal flame are typically directed through a 90° elbow, generally vertically to another 90° elbow, through a screen and then into a rotatable drum in which clothes are dried. An air blower may be disposed upstream or downstream of the burner for directing air in the drum of the dryer.

Typical gas dryer burner nozzles can be difficult and relatively expensive to manufacture. Generally, such burner nozzles are fabricated by a practice of shaping the body from tubing and attaching flame spreaders and brackets by welding. Another problem with conventional dryer burner applications is that they are susceptible to igniter breakage. More specifically, the igniters are connected directly to the burner nozzle and, being fragile, may crack or break off during shipping and handling.

SUMMARY OF THE INVENTION

The present invention is directed to a burner nozzle for producing shaped and/or shortened flame for efficient heat transfer. The burner is characterized by flame-shaping openings for shaping the flame. Alternatively, or in combination with the flame-shaping openings, the burner nozzle may include a flame length reducing member. The burner is particularly well suited for use in clothes dryers where flame that is elongated transverse to the direction of gas flow and has a reduced length, reduces fabrication costs and results in efficient heat transfer.

In general, a first embodiment of the invention is a burner nozzle that includes a burner tube that extends along a central axis and has an inlet end portion for receiving combustible gas and air and an outlet opening for releasing a mixture of the gas and air. A main gas flow passage extends along the central axis between the inlet end portion and the outlet opening. At least one chamber has at least a portion disposed alongside and in communication with the main gas flow passage along the central axis. At least one flame-shaping opening is located adjacent the end face. Each chamber extends along the central axis to an associated flame-shaping opening. Each flame-shaping opening is constructed and arranged effective to elongate flame resulting from combustion of the mixture transverse to the central axis to produce efficient heat transfer between the flame and air inside a heat-receiving member such as a duct, located downstream of the outlet opening.

As to the specific features of the burner nozzle of the first embodiment, the outlet opening may be disposed along a plane of an end face of the burner tube. Each elongated flame-shaping opening may be located only in or generally parallel to the plane of the end face such that the mixture only leaves the burner tube through each flame-shaping opening and the outlet opening. Each chamber may extend along the central axis to an associated flame-shaping opening and has a generally uniform height along its entire length. A device for igniting the mixture may be fastened to the combustion tube and positioned offset from the outlet opening and aligned with a flame-shaping opening. The outlet opening is generally circular and two flame-shaping openings may have a rectangular shape and be located around the outlet opening diametrically opposed from each other.

In general, a second embodiment of the invention is directed to a burner nozzle comprising a burner tube that extends along a central axis and has an inlet end for receiving a combustible mixture of gas and air. A body has a passageway in communication with the burner tube and has an elongated outlet end portion. At least one flame shaping opening is disposed near the outlet end portion for releasing a mixture of the gas and air. A baffle formed integrally with the body may project outwardly near the outlet end portion for obstructing air flowing externally of the burner nozzle.

More specific features include at least one tab portion that extends at an angle with respect to the central axis to obstruct at least a portion of the flame-shaping opening. Each tab portion has a first section that extends from the body at an angle with respect to the central axis and a second section that extends from the first section substantially perpendicular to the central axis. Also included are a first set of the tab portions and a second set of the tab portions that face each other. The tab portions in the first and second sets extend from the body in an alternating "zipper like" arrangement relative to each other. Alternatively, an end face may be disposed near the outlet end portion and have at least one angled or curved surface relative to the central axis, a plurality of the flame shaping openings being disposed in the surface. At least one recess may project inwardly from the body and restricts the passageway for directing flow of the gas and air in the body.

A preferred aspect of the burner nozzle comprises a burner tube that extends along the central axis and has an inlet end for receiving a combustible mixture of gas and air.

The body has a passageway in communication with the burner tube and an elongated outlet end portion. The end face is disposed near the outlet end portion and has at least one angled or curved surface. A plurality of flame shaping openings are disposed in the surface for releasing a mixture of the gas and air.

Another preferred aspect of the burner nozzle comprises a burner tube that extends along the central axis and has an inlet end for receiving a combustible mixture of gas and air. The body has a passageway in communication with the burner tube and an elongated outlet end portion. At least one flame shaping opening is disposed near the end portion for releasing a mixture of the gas and air. At least one tab portion extends at an angle with respect to the central axis so as to obstruct at least a portion of the at least one flame shaping opening. The tab portion preferably extends outward from the outlet end portion of the burner in a region in which there is no flame or in an initial or cool portion of the flame.

A burner assembly may be formed by fastening the inventive burner nozzle in the interior of a combustion tube. The combustion tube may be comprised of two articles formed of stamped metal or a single rolled form. Wing members flank the burner tube, each wing member being fastened between the articles. Only a single burner nozzle is preferably used in the nozzle assembly, such as in the case of the clothes dryer application. The heat-receiving member or duct comprises a passageway having a portion of a shape that corresponds to the elongated shape of the flame.

A general method of producing shaped flame from a burner nozzle comprises directing combustible gas and air into the inlet end portion of the burner tube that extends along the central axis. The gas and air are mixed in the burner tube. The mixture is directed along the central axis toward an elongated outlet end portion of the burner. The mixture is passed through at least one flame shaping opening disposed near the outlet end portion. The mixture is ignited to produce flame. The flame is shaped to have at least one elongated side portion extending transverse to the central axis.

In particular, the method may include the following variations. Heat may be directed from the shaped flame to a heat-receiving member located downstream of the outlet opening effective to produce an efficient heat transfer between the flame and air inside the heat receiving member. The heat may be directed from the shaped flame into a passage of the heat-receiving member which has an elongated portion of a shape that corresponds to the elongated portion of the shaped flame. A length of the flame may be reduced by diverting the mixture while unignited, with at least one diverter portion extending at an angle or direction so as to obstruct a portion of the at least one flame shaping opening. Flame may be prevented from cross-igniting combustible gas from other burner assemblies. Air may be obstructed from flowing externally of the burner, using at least one baffle disposed near the outlet end portion. The outlet end portion may be generally rectangular, and the method may include passing the mixture through the flame shaping openings along the outlet end portion to elongate the flame transverse to the central axis. The burner nozzle may comprise a generally circular outlet opening near the outlet end portion which is flanked by two generally rectangular side openings, and the method may comprise passing the mixture through the side openings to elongate- transverse to the central axis- the flame from the circular opening.

The present invention offers numerous advantages over prior gas dryer burners. Each chamber and flame-shaping opening enables elongation of the flame transverse to the central axis of the burner nozzle. This results in a flame that has an ideal shape when used with ductwork having a corresponding elongated (e.g., rectangular) passageway. There is an efficient heat transfer between the elongated flame and the air in the duct since there is less wasted space compared to the use of a circular shaped flame in a rectangular shaped duct, for example.

Alternatively, or in addition to the flame-shaping feature, the burner nozzle may produce a shortened flame having a length of, for example, about half that of conventional burner nozzles used in clothes dryers. In vertical firing applications there is a shorter distance between the end of the flame and the entry to the drum than in horizontal firing applications. Therefore, flame that is too long may overheat the ductwork, the screen or the dryer load. The present invention advantageously utilizes a flame length reducing member that is not subjected to the intense heat of the flame, resulting in the ability to form this member of the same or different material as the burner nozzle.

The igniter may be connected to the combustion tube rather than to the burner nozzle, which is believed will reduce breakage of the fragile igniter. Moreover, the igniter may be aligned with one of the side chambers instead of directly in the path of the primary flame, which is believed will result in less heat on and increased life of the igniter.

Other embodiments of the invention are contemplated to provide particular features and structural variants of the basic elements. The specific embodiments referred to as well as possible variations and the various features and advantages of the invention will become better understood from the accompanying drawings together with the detailed description that follows.

DETAILED DESCRIPTION OF PREFERRED EMBODIMENTS

Figure 1:
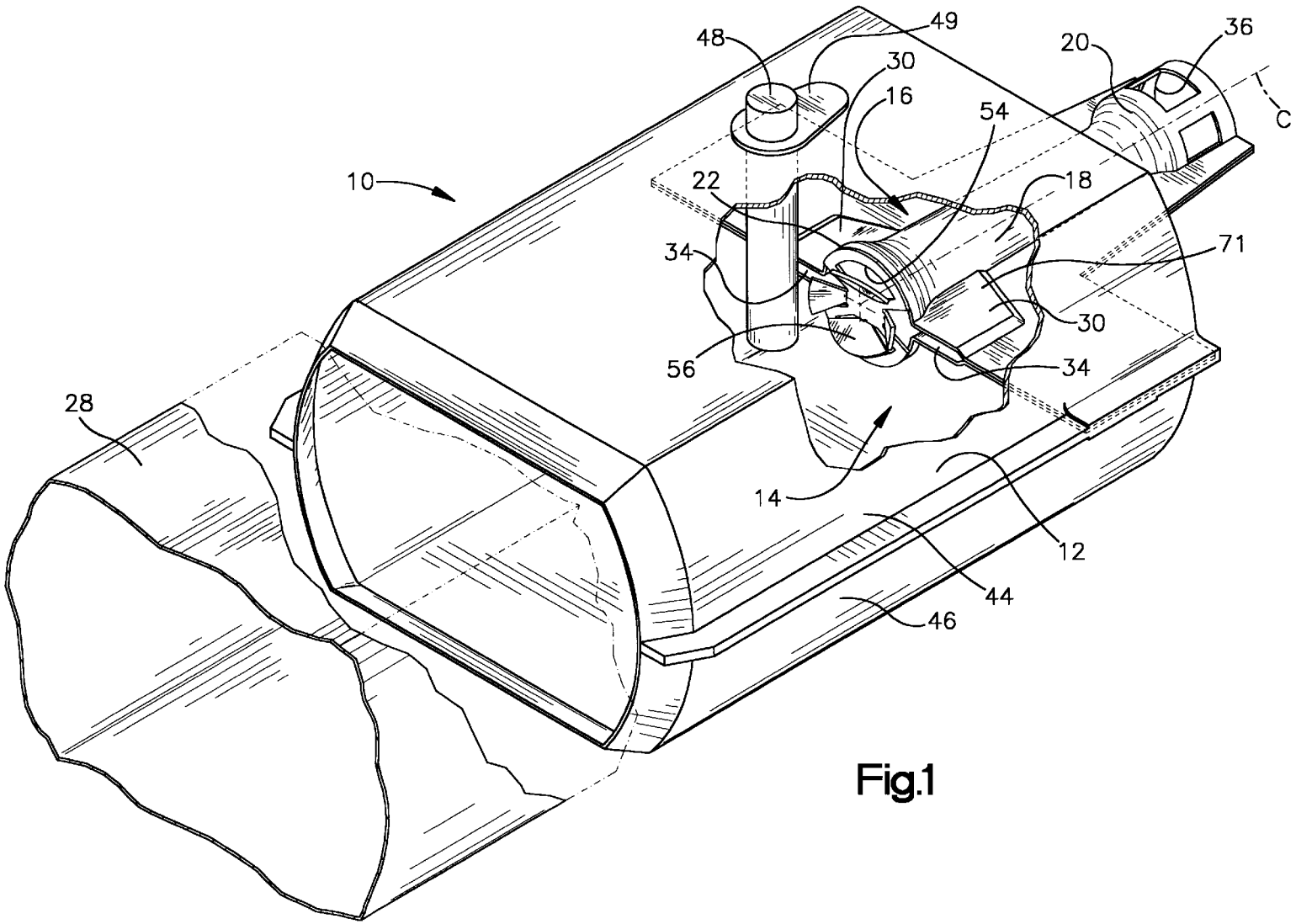
FIG. 1 is a perspective view of an outlet end portion of a gas burner assembly constructed in accordance with the present invention.
Figure 2:
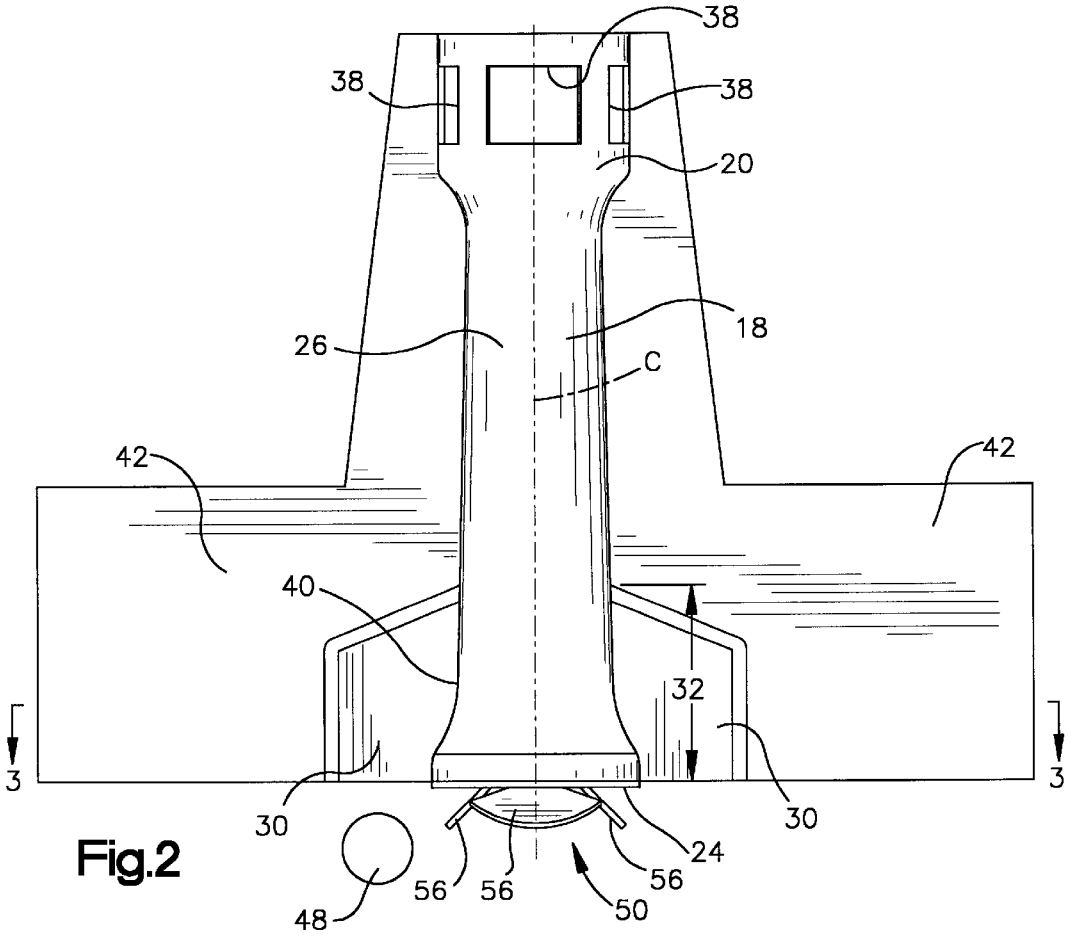
FIG. 2 is a top plan view of a burner nozzle shown in FIG. 1.

Referring now to the drawings and to FIGS. 1–4 in particular, one embodiment of a burner assembly constructed in accordance with the present invention is designated generally by reference numeral 10. An outer combustion tube 12 surrounds an interior region 14 in which a burner nozzle 16 is disposed. The burner nozzle includes a burner tube 18 that extends along a central axis C and has an inlet end portion 20 for receiving combustible gas and air and an outlet opening 22 for releasing a mixture of the gas and air. The outlet opening is preferably disposed substantially along a plane of an end face 24 of the burner tube (FIG. 2). A main gas flow passageway 26 extends along the central axis between the inlet end portion and the outlet opening. A heat-receiving member 28, such as a duct leading to a drum of a clothes dryer, is disposed downstream of the outlet opening relative to a direction of flow of the mixture. Side chambers 30 each have a portion 32 which is disposed alongside and in fluid communication with the main gas flow passage along the central axis. Flame-shaping openings 34 are each located adjacent the end face 24. Each side chamber 30 extends along the central axis to an associated flame-shaping opening. Each flame-shaping opening is constructed and arranged effective to elongate flame F1 (FIG. 3) resulting from combustion of the mixture-transverse to the central axis, to produce efficient heat transfer between the flame and air inside the duct.

A gas supply opening 36 at the inlet end portion of the burner tube is sized so that the burner tube may be fitted in a conventional manner to a gas valve. The term "gas" is used herein in reference to combustible fuel in gaseous form. It will be appreciated that any suitable gaseous combustible fuel may be used, such as natural gas, propane, butane and other gas mixtures. Air supply openings 38 are formed at the inlet end portion of the burner tube. Those skilled in the art would appreciate in view of this disclosure that the size of the air supply openings may be adjusted as desired to be fixed upon fabrication or may be variable using a shutter, depending upon the air flow requirements of the particular application. As the gas flows by the air supply openings it entrains air into the burner tube.

Figure 3:
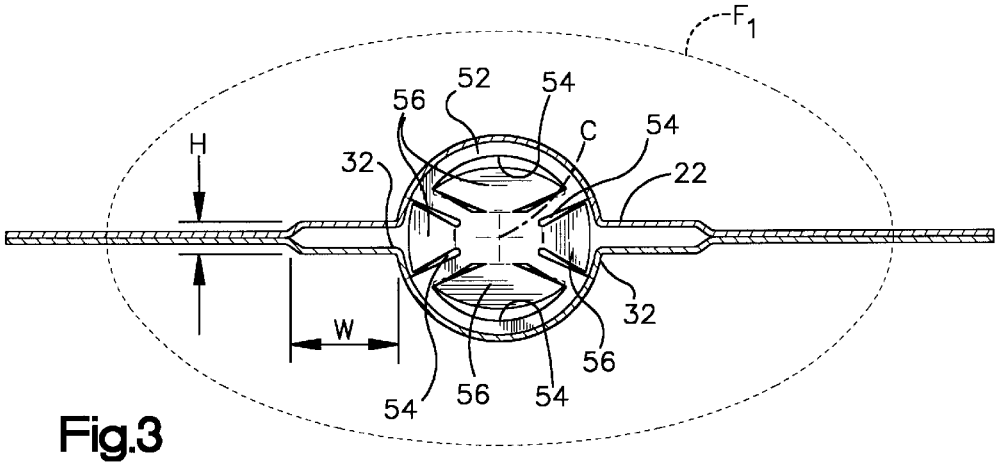
FIG. 3 is a cross-sectional view as seen along the plane represented by line 3—3 in FIG. 2.

Each side chamber extends along the central axis alongside the main passageway in communication with the interior of the burner tube. The main passageway preferably has a shape shown in FIGS. 1 and 2 that forms a venturi in the well known manner. Depending upon the application, none, one or more side chambers 30 may be used. However, it is most preferable from the standpoint of design and performance of the burner nozzle, especially in the application of clothes dryers, for two side chambers to be used and for the chambers to flank the burner tube at the outlet end portion as shown in FIG. 2. The side chambers are preferably spaced apart from each other by about 180 degrees. Each flame-shaping opening 34 communicates with a side chamber 30 as best shown in FIG. 1, the flame-shaping opening preferably forming a terminal portion of the side chamber. Each side chamber preferably has a height which is substantially uniform along its entire length along the central axis (i.e., along side portion 32) to the associated flame-shaping opening. This results in a pressure inside the side chamber which is approximately the same as or slightly higher than the pressure inside the main passageway 26. Each flame-shaping opening has an elongated shape, e.g., the flame has a portion with a generally rectangular cross-sectional shape transverse to the central axis (as shown in FIG. 3).

Each flame-shaping opening is preferably located in the plane of the outlet end face 24 or substantially parallel thereto. Only one burner is preferably used in appliances such as clothes dryers and thus, the burner nozzle preferably has no openings on a side 40 of the burner tube or on a side of the chambers 30 for cross ignition of other burners. Wing-shaped members or fins 42 are preferably formed integrally with and flank the burner tube. Each wing member may include one of the side chambers. The wing members extend outwardly and are each trapped between two stamped articles 44, 46. The wing members may be connected to the combustion tube in any suitable manner such as by sliding the ends of the wing members into slots formed in the combustion tube or by trapping them between two halves of the combustion tube as shown in FIG. 1. This avoids the need for separate brackets to attach the burner nozzle to the combustion tube.

An igniter component shown generally at 48 is mounted to the combustion tube such as by fastening a bracket 49 to the combustion tube, and is suspended adjacent the burner nozzle. The igniter generates heat which produces the flame as a result of combustion of the mixture of the combustible fuel and air in the well known manner. Examples of suitable igniters are Model No. 004 WE04 X0739 by Carborundum and Model Nos. 101 and 271 by Norton. Igniters are comprised of fragile ceramic material such as silicon carbide and may break if jarred. Fastening the igniter to the combustion tube is advantageous in that it may reduce breakage of the igniters during shipment, handling or installation. Any impact on the burner assembly or on the igniter is believed to be distributed across the body of the combustion tube, which may reduce breakage of the igniter.

The life of an igniter is believed to be reduced if it is exposed to cycles of excessive heating and then cooling over extended periods of time. The igniter is preferably offset from the outlet opening in a direction transverse to the central axis and is aligned with one of the flame-shaping openings. This subjects the igniter to reduced heat, since it is disposed in flame corresponding to gas from the flame-shaping openings 34, instead of in flame and significantly greater heat corresponding to gas from the outlet opening 22 as is conventional. The present construction also enables the igniter to be positioned further away from the burner tube and any flame shape influencing member. This allows the igniter to be mounted to the combustion tube which may absorb shock better than when the igniter is connected to the burner nozzle. In the present invention the igniter may be located a greater distance away from the outlet of the burner nozzle than is conventional, in a position that is best suited for improving ignition characteristics. For example, the igniter may be spaced apart from the burner tube or the flame-shaping member by a distance ranging from at least about ¼ inch to about ½ inch.

The burner assembly may also comprise a flame length reducing member 50 which may be in the form of an insert that is received by the outlet opening 22 or may be integrally formed with the burner tube. In particular, the flame length reducing member 50 is preferably used in conjunction with the side chambers and flame-shaping openings. Alternatively, the flame length reducing member may be used without the side chambers and flame-shaping openings. However, this would produce a longer, generally circular, unshaped flame compared to when the side chambers and flame-shaping openings are employed. The flame length reducing member 50 may be integrally formed with the nozzle and have a free end bent and connected to the burner nozzle. The member includes a body portion 52 which obstructs a portion of the outlet opening 22. Passages 54 are disposed through the body portion for receiving the air/gas mixture. Diverter portions 56 are disposed, each preferably adjacent one of the passages 54, at an angle relative to a direction of flow of the air/gas mixture to divert the flow. The diverter portions may be formed separately from the body portion or integrally therewith. The flame length reducing member reduces the length of the flame from the burner assembly. Conventional dryers have a limited horizontal space of about 1½ to 2 feet, for example, in which to position the burner. Therefore, shortening the flame advantageously tailors the heat transfer to use in clothes dryers.

Figure 4:
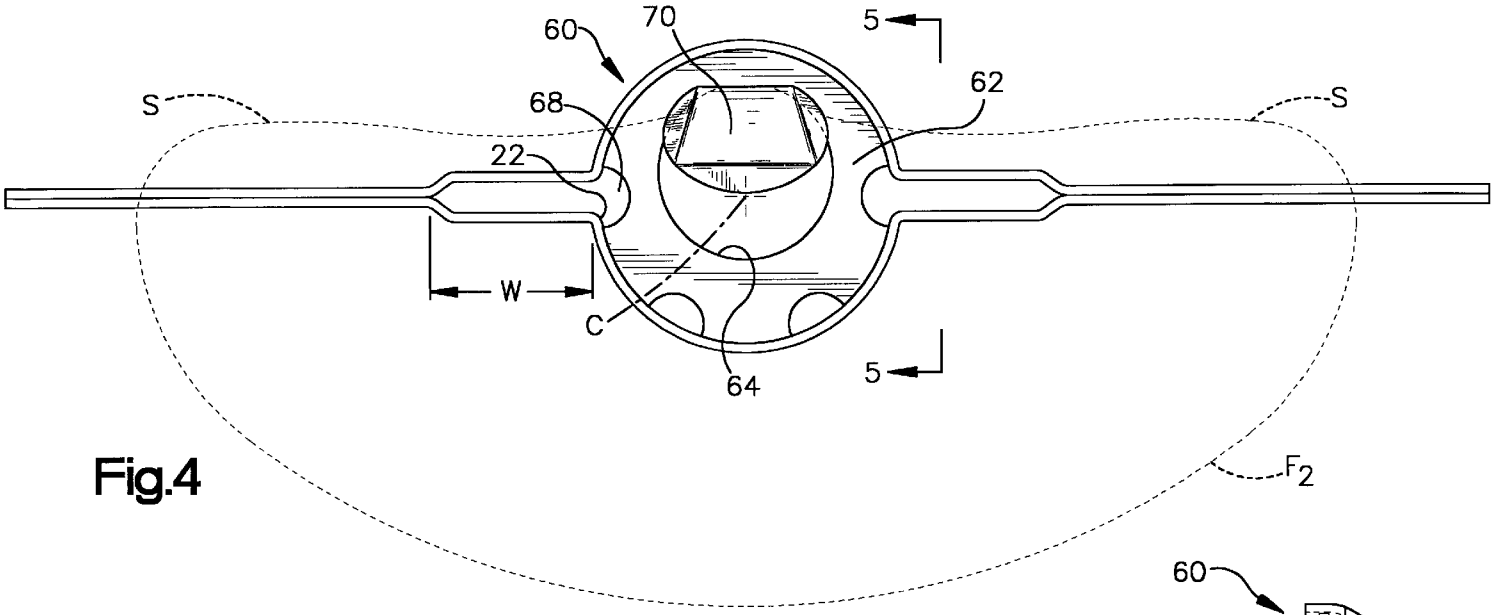
FIG. 4 is a front elevational view illustrating a flame length reducing member.
Figure 5:
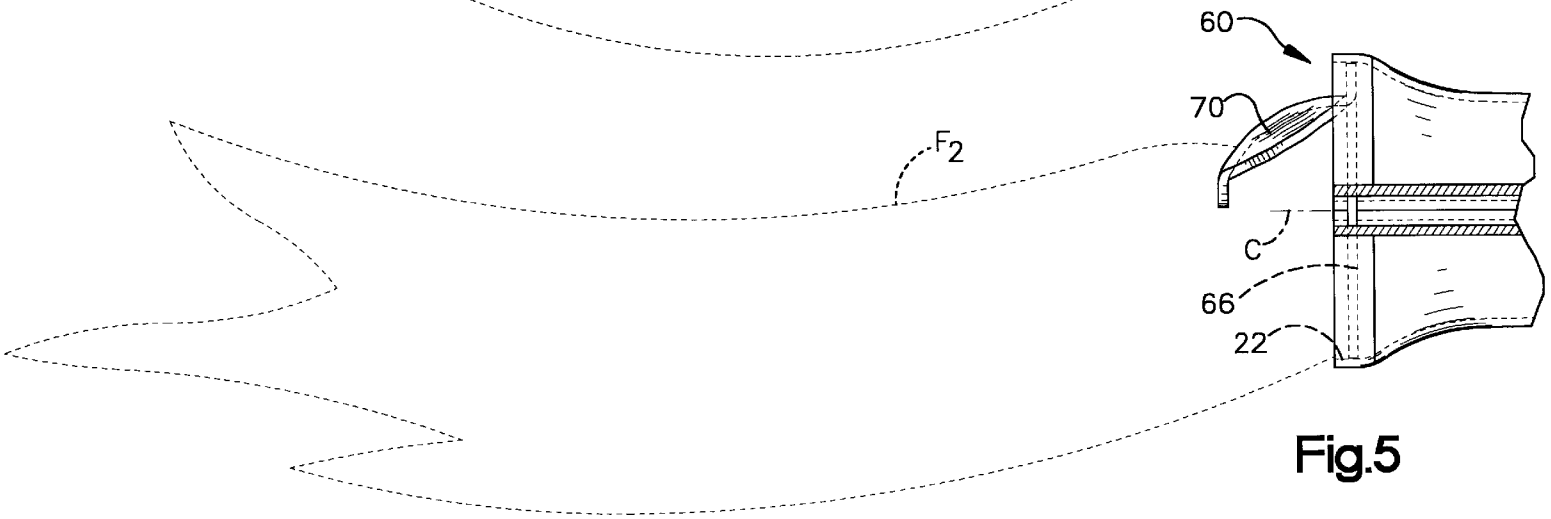
FIG. 5 is a side elevational view of the flame length reducing member as shown by the lines designated 5—5 in FIG. 4.

Another flame length reducing member 60 constructed according to the present invention for use in horizontal applications, is shown in FIGS. 4 and 5. The member may be inserted into the outlet opening 22 of the burner tube 18. The member includes a body portion 62 received by the outlet opening having at least one opening 64 therein which is preferably centrally located. The body portion may be integrally formed with the burner nozzle and may be fastened at its free end to the burner nozzle in any suitable fashion. The body may also be received in a groove 66 formed in an end of the burner tube adjacent the outlet opening. The body would be trapped between the upper and lower halves of the burner. Alternatively, the body may be located in a groove further within the burner nozzle and the end portion of the nozzle may be folded over to keep the body in place. Openings 68 are located around the main opening 64 and improve the performance of the burner. A diverter portion 70 extends downwardly from the body portion at an angle with respect to a direction of flow of the mixture. The diverter is preferably in the shape of a scoop as shown in FIG. 5 for effective prevention of flame lifting. The mixture passes through the opening in the body while unignited and is diverted downwardly by the diverter portion of the body. The flame resulting from combustion of the air/gas mixture leaving the outlet opening is generally in the form of a semicircle. Referring to FIG. 4, the flame F2 corresponds to the mixture from the lower portion of the outlet opening which is unobstructed by the diverter portion. The flame-shaping openings provide elongated sides S to this semicircle shaped flame.

The burner assembly 10 as shown in FIG. 1 is suitable for use with both horizontal and vertical flow of the air/gas mixture. A characteristic of horizontal firing is that the flame has a tendency to rise. The burner must be designed to accommodate this characteristic. Other concerns are avoiding flashback and liftoff. Flashback concerns are addressed, for example, by constructing the chamber with an angled portion 71 (FIG. 1).

The severity of flashback and liftoff may vary depending upon factors including the type of combustible fuel that is used, port loading and primary aeration. In vertical and horizontal firing the combustion tube and duct have corresponding shapes (e.g., both are generally rectangular or oval shaped). The ducts may also be circular such as in horizontal firing in which case the side chambers 30 may be omitted or used to elongate the flame with their attendant advantages.

Figure 6:
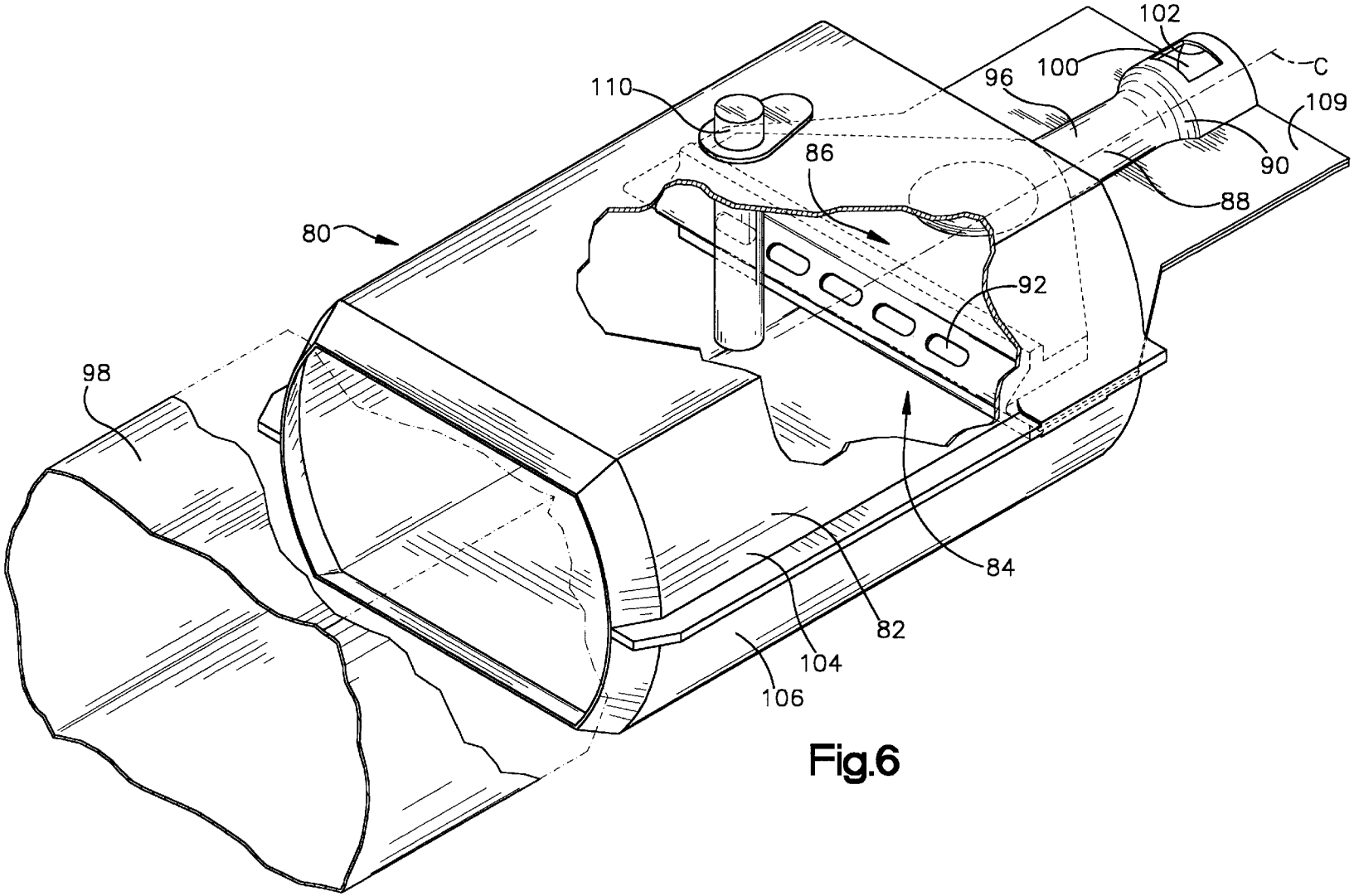
FIG. 6 is a perspective view of an outlet end portion of another embodiment of a gas burner assembly constructed in accordance with the present invention.

Referring now to FIG. 6, a burner assembly of another embodiment of the present invention is shown generally at 80 and is suitable for use in horizontal and vertical firing applications. More preferably the burner assembly is used in vertical firing applications. The burner assembly includes a combustion tube 82 that surrounds an interior region 84 in which a burner nozzle generally designated 86 is disposed. The burner nozzle includes a burner tube 88 that extends along a central axis C. An inlet end portion 90 receives combustible gas and air. A gas supply opening 100 at the inlet end portion of the burner tube is sized so that the burner tube may be fitted in a conventional manner to a gas valve. Air supply openings 102 are formed at the inlet end.

The combustion tube is preferably formed of two articles of stamped metal 104, 106. The burner tube extends along the central axis within the combustion tube. Wing shaped members or fins 109 flank the burner tube, and extend outwardly so as to be trapped between the two stamped articles for mounting the burner tube to the combustion tube as described with respect to the burner nozzle 16.

A generally cylindrical main flow passageway 96 extends within the burner tube 88 along the central axis from the inlet end portion of the burner nozzle to a body 94. A series of ports 92 are disposed near an outlet end portion 93 of the body for releasing a combustible mixture of the gas and air.

An igniter component 110 is mounted to the combustion tube and suspended adjacent the flame-shaping outlet openings by a distance such as that shown and described in connection with the first embodiment. A heat-receiving member 98, such as a duct leading to a drum of a clothes dryer, is disposed downstream of the flame-shaping openings relative to a direction of flow of the mixture.

Figure 7:
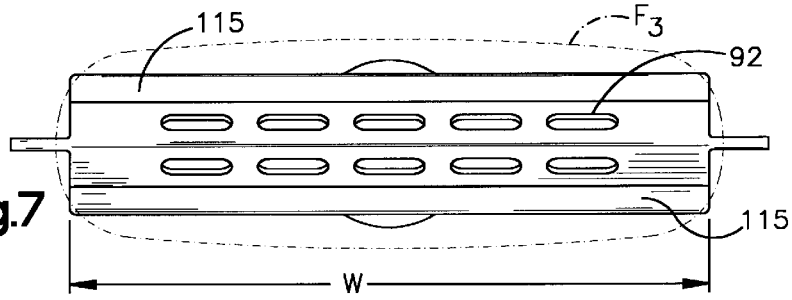
FIG. 7 is an end view of the burner nozzle of FIG. 6.
Figure 8:
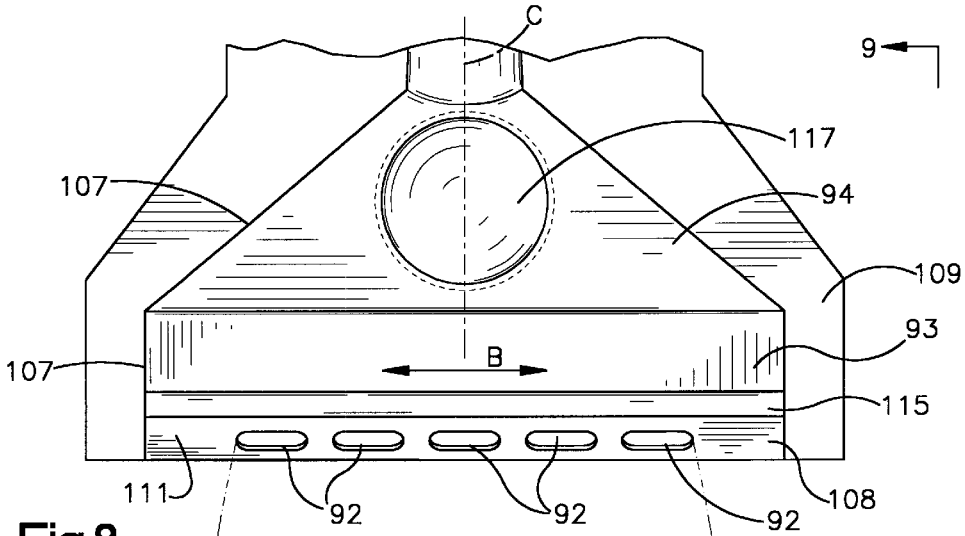
FIG. 8 is a front view of the burner nozzle shown in FIG. 6.
Figure 9:
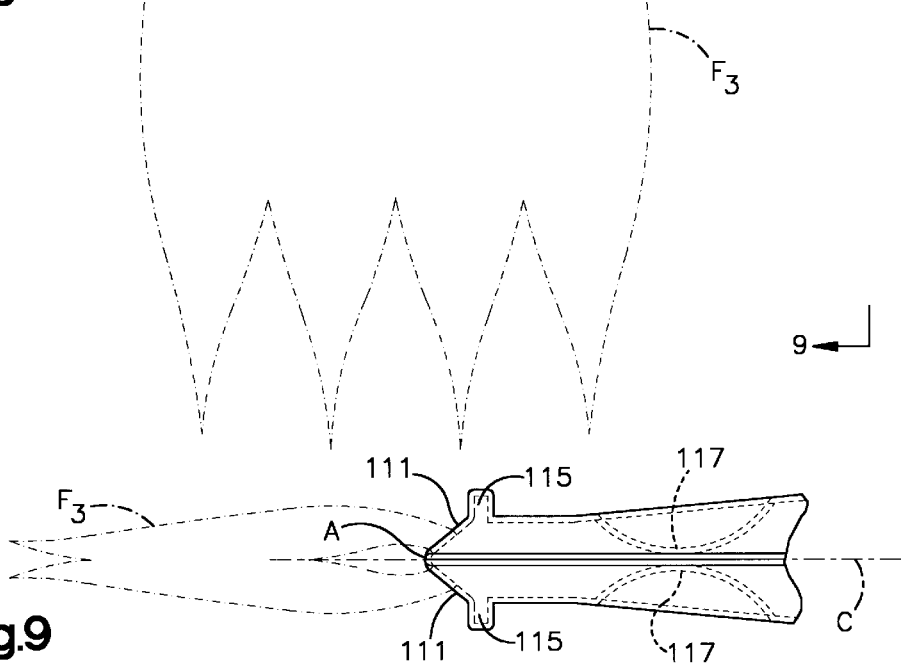
FIG. 9 is a side elevational view of a flame length reducing member as seen along the lines designated 9—9 in FIG. 8.

Turning now to FIGS. 7–9, the chamber or body 94 has a passageway in communication with the main passageway 96. The body is preferably integrally formed with the burner tube. The passageway of the body has a shape (e.g., generally triangular or the like) with the width of the chamber increasing in the direction of the gas flow to the elongated outlet end portion 93. A generally circular inwardly projecting dimple 117 is disposed on the chamber surface. More preferably, two dimples are diametrically disposed on opposing chamber surfaces and are preferably located along the central axis C. The dimples gradually taper from the chamber surface to a depressed center point. It is believed that the dimples balance pressure and flow in the burner. As a result, it is believed that the dimples minimize lifting of the flame as it is directed away from the burner nozzle by enabling faster moving gases along centerline C to be slowed to a velocity approximating that of the gas flowing peripherally outside the dimples.

The burner nozzle includes an end face shown generally at 108 near the outlet end portion of the chamber. The end face preferably has two, e.g., planar, surfaces 111 that are each at an angle of about 40 degrees from the central axis. An arcuate portion A connects the two surfaces. The series of ports 92 are disposed on one or both of the surfaces for releasing the combustible mixture of the gas and air. The sizes, arrangement and angle of the openings (i.e., of the surfaces 111) may be varied as would be apparent to one skilled in the art in view of this disclosure, for example, the end face angle may range from 35 to 45 degrees or it may be curved.

A secondary air baffle 115 is disposed adjacent to the outlet end portion. Preferably, two of the secondary air baffles 115 are used. The secondary air baffle extends parallel to the end portion in a direction B generally transverse to the central axis. It is believed that the secondary air baffles minimize lifting. In particular, the secondary air baffles herein and in other embodiments of the invention deflect turbulent air from blowers, which are located upstream or downstream of the burner, that is traveling in a direction from the burner nozzle inlet end portion to its outlet end portion, from interfering with the flame.

As shown in FIG. 7, the flame-shaping outlet openings are preferably elongated or oval shaped. The nozzle assembly preferably has no openings on the side 107 of the burner for cross ignition of other burners. Only one burner 86 is preferably used in the clothes dryer application. The flame F3 resulting from a combustion of the air and gas mixture is shown in FIGS. 7–9. Each row of flame shaping openings provide a separate flame that converges into one flame downstream of the burner nozzle such that an air pocket may exist along the central axis adjacent the exterior end portion as shown in FIG. 9. The flame is elongated and generally six to ten inches in length to produce efficient heat transfer between the flame and air inside the duct.

Figure 10:
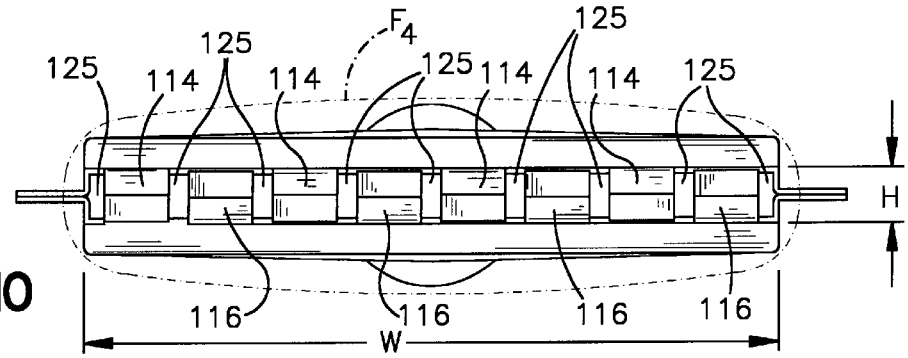
FIG. 10 is an end view of another embodiment of a gas burner nozzle constructed in accordance with the present invention.
Figure 11:
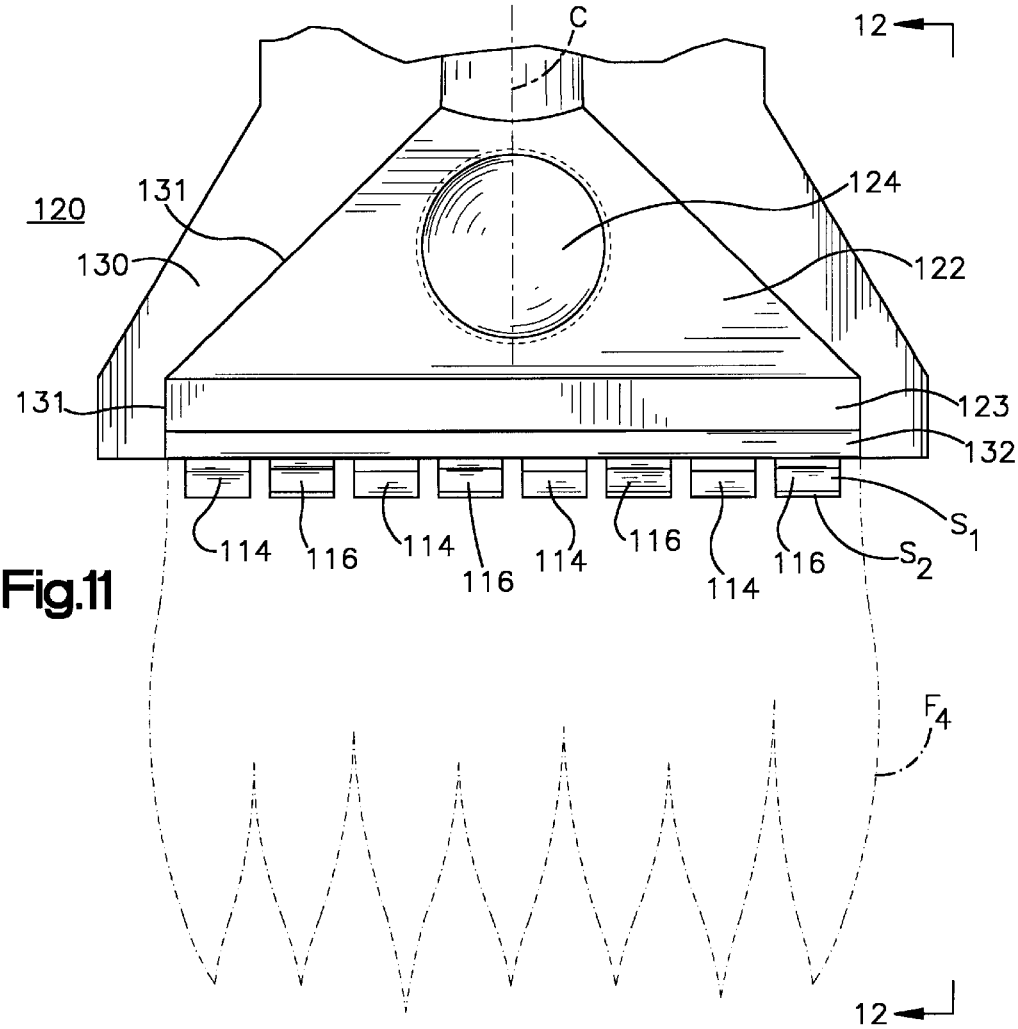
FIG. 11 is a front view of the gas burner nozzle shown in FIG. 10.
Figure 12:
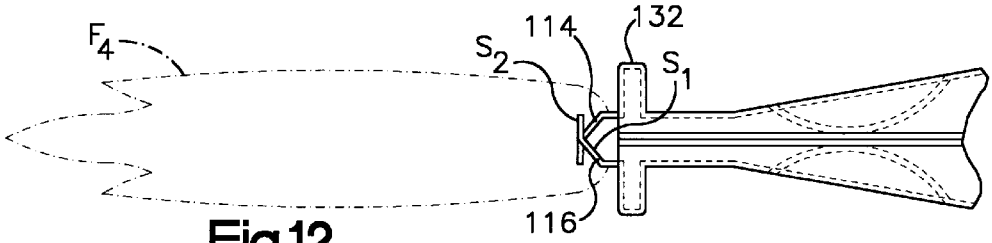
FIG. 12 is a side elevational view of the burner nozzle as seen along the lines designated 12—12 in FIG. 11.

FIGS. 10–12 show another embodiment of a burner nozzle generally at 120 for use in the burner assembly 80 instead of the burner nozzle 86, wherein like reference numerals designate like parts throughout the several views. A chamber or body 122 is, for example, preferably generally triangular shaped or the like, with the width of the chamber increasing in the direction of the gas flow to an elongated outlet end portion 123. A generally circular inwardly projecting dimple 124 is disposed on the chamber surface. The dimple gradually tapers from the chamber surface to a depressed center point. More preferably, two dimples are diametrically disposed on opposing chamber surfaces and are preferably located along the central axis. Other shapes, sizes and configurations of the dimples will be apparent to those skilled in the art in view of this disclosure, such as triangular shapes or crescent moon shapes. As in the previous embodiments, the dimples decrease the velocity of gas flow along the central axis.

Extending from the end portion 123 are a first row of tabs 114 and a second row of tabs 116. The sizes and angles of extension of the tabs may be varied as would be apparent to one skilled in the art in view of this disclosure. Preferably, each tab has a first section S1 that is integral with the body (FIG. 12), which extends at an angle of, for example, 45 degrees, from the central axis. A second section S2 of each tab extends from the first section at another angle of, for example, 45 degrees, such that the second section is substantially transverse to the central axis (i.e., parallel to the secondary baffle 132). The tabs are preferably arranged zipper-like, such that a tab from the first row alternates with a tab from the second row as shown in FIGS. 10 and 11. The tabs 116 are generally upwardly facing and the tabs 114 are generally downwardly facing as shown in the drawing, although it will be appreciated that the present invention should not be limited to directions such as upward and downward, since the burners may be used in vertical firing applications. Between each adjacent tab 114, 116, and between outermost tab ends and end of the outlet end portion, are spaces 125. Lifting and flashback may be minimized when a portion of the tab (S2) is substantially parallel to the flame-shaping opening. Also, a space between the outlet end portion where the mixture first leaves the body, and the second tab section S2, is selected to keep the tabs in the cool portion of flame or not in flame at all, while avoiding flashback and liftoff. Without the portion S2, there may be flame liftoff. The mixture leaving the nozzle is diverted by the first and second rows of tabs and results in a flame F4 that is reduced in length. Rather than employing tabs, the flame length reducing member 120 may include diverter portions that have other suitable shapes and extend from the burner nozzle at suitable angles relative to the direction of gas flow, for example, in the range of 40–50 degrees.

Adjacent to the end face is at least one secondary air baffle 132. The secondary air baffle extends parallel to the end face and is generally transverse to the central axis as in the previous embodiment.

Wing shaped members or fins 130 flank the burner tube, and extend outwardly so as to be trapped between the two stamped articles for mounting the burner tube to the combustion tube as described with respect to the burner nozzle 16. The nozzle assembly preferably has no openings on the side 131 of the burner for cross ignition of other burners The flame length reducing members of the present invention, 50, 60, 111, 114/116, may be received in the outlet opening of the burner tube as inserts or be integrally formed with the body. However, it will be appreciated that in all embodiments of the present invention the flame length reducing members are not subjected to direct flame or at least are disposed in a location where flame is just forming and thus, are in a relatively cool location. Moreover, flame reducing members 50, 60 and 114/116 may be spaced in a direction of the central axis between the outlet end portion or end face of the burner tube, and the igniter, as long as the flame length reducing members are not subjected to the intense heat of the flame. Although not wanting to be bound by theory, the flame length reducing members are not directly immersed in flame, although flame may curl around portions of the member near openings in the body portion, and as a result, are exposed to lesser temperatures. This may enable the flame length reducing members to be formed of materials which do not need to withstand a very high temperature environment and may increase their life.

Using natural gas at 22,000 Btu/h in a clothes dryer, the member 60 of the burner shown in FIGS. 4 and 5 had a maximum temperature of 640° F. The flame length reducing members may be formed of suitable materials such as aluminized or stainless steels. In contrast, in that environment a maximum temperature of a scoop flame spreader, Burner No. 32056 by Beckett Gas, Inc., made of 430 stainless steel, is expected to be at least 1100° F. Burner nozzles of the present invention may also utilize conventional flame spreaders, although this is less advantageous.

The flame-shaping openings 34, 92, 125, elongate the flame transverse to the longitudinal direction of the burner tube and produce a substantially oval, rather than circular flame (see FIGS. 3, 4, 7 and 10). The flame may be elongated on only one side (as a result of selection of the location or arrangement of the holes) but is preferably elongated on both sides as seen from the end view, to produce efficient heat transfer between the flame and the air inside the ductwork of corresponding shape. The flame-shaping openings 34, 92, 125, may also reduce the length of the flame somewhat compared to the use of the outlet opening 22 without the flame-shaping openings. The combustion tube preferably has an elongated shape which approximates a shape of the adjacent duct of the dryer. Therefore, the shaped and/or shortened flame produces heat which is more uniformly distributed throughout the combustion tube and duct and results in efficient heat transfer between the shaped flame, air inside the duct and, ultimately, air inside the drum. While not wanting to be bound by theory, it is believed there may be a measurable increase in the heating efficiency of clothes in the drum of the dryer (a reduction in BTU/water evaporated in the drum), which is attributable to the shaped and/or shortened flame.

The following are exemplary dimensions of burner nozzle assemblies of the present invention. Each chamber and flame-shaping opening is at least ⅛ inch in height H in both horizontal and vertical firing applications (see, e.g., FIG. 3). The chamber is formed with this minimum height to avoid the possibility of clogging due to seepage of lint from the drum. In vertical firing the chamber preferably ranges from about ¼ inch to about ½ inch in height H. In horizontal firing the width W of each side chamber 30, and width W of each flame-shaping opening, outward from the outlet opening 22 (see FIG. 4), ranges from about ½ inch to about 1 inch and, preferably, is about ¾ of an inch. In vertical firing, the width W of each chamber and width of each flame-shaping opening, outward from the outlet opening (see FIG. 3), ranges from about 1¼ inch to about 1½ inch. The dimensions of the burner nozzles shown in FIGS. 6–12 may be similar to those described above. In the invention, flame length preferably ranges from about 6–10 inches in a combustion tube of about 12 inches in length. All of the above dimensions are provided only for purposes of illustration and the design of the burner nozzle may be varied by one skilled in the art without departing from the scope of the invention, such as in the case of burners of different inlet and outlet opening areas. The above dimensions of the burner shown in FIG. 1–5 are particularly preferred with regard to an outlet opening of about 1¼ inches in diameter. Increasing this outlet opening size may result in a corresponding increase in suitable dimensions of the chambers and flame-shaping openings.

The combustion tube may be formed of galvanized or aluminized steel, for example. The burner nozzle may be formed of any suitable materials such as aluminized or stainless steel. The combustion tube is preferably formed of two articles of stamped metal, which simplifies and reduces the cost of manufacture. The wing-shaped members are preferably formed integrally with and flank the burner tube.

Each wing member includes one of the chambers. The wing members extend outwardly and are each trapped between the two stamped articles, which provides a simple way for mounting the burner tube to the combustion tube.

The burner may be fabricated from two sheet metal halves or from one single sheet. In the preferred and illustrated embodiment, the two halves of the burner are mirror images of one another. This facilitates cost-effective fabrication since the dies used to fabricate each sheet metal half are also mirror images of each other. The first step is to size each sheet metal half for the appropriate height and width. The height of the sheet metal includes such factors as the desired height of the side chamber and main passage as well as the width of the wings. The width of the sheet metal includes such factors as the desired length of the main passageway, side chambers and gas supply passage.

The air supply openings in the inlet end portion are formed in each sheet metal half. The sheet is then stamped in a die configured to form integral "half sections" each containing the features of the nozzle. The two sheet metal halves are then joined together and form a gas tight seam.

In the case of a burner which employs a flame length reducing member, one or both of the sheet metal halves may be stamped to include the shape of the flame length reducing member(s). The diverter portions when formed integrally with the body, may be bent to the desired angle. The member may then be bent 90° into position and fastened in the outlet opening of the burner nozzle. This enables the member to be fabricated easily in a cost effective manner, since the member need not be separately formed and then attached with welding or the like.

In the case of the flame reducing member 112 shown in FIGS. 6–9, a single metal sheet may be used to fabricate the entire burner nozzle. A die is fabricated to stamp onto a single metal sheet an image containing the features of the flame length reducing members and burner. The image is comprised of two mirror images for each half section and is bent such that the mirror images are superimposed and an arcuate portion may be formed about the axis at which the metal is bent. The planes having the flame-shaping openings contained therein are preferably at a 35–45 degree angle from the central axis or may be tapered or curved. The top and bottom halves are secured such that a tight gas seal exists.

Regarding operation of the burner of the first embodiment, for example, combustible gas is fed into the gas opening of the burner tube from the gas valve in a manner known to those skilled in the art. Air is entrained by the gas into the burner tube. The air and gas is mixed in the venturi and travels toward the outlet end portion. A portion of the air and gas passes into each side chamber to the associated flame-shaping opening. A principal portion of the air and gas flows through the main passageway to the outlet opening. In the other embodiments, the air and gas inside the burner tube enters the body or chamber 94, 122 and travels through the flame-shaping openings 92 or 125.

The igniter is preferably in alignment with one of the flame-shaping openings 34, 92, 125. The igniter is operated in a known manner and flame results from combustion of the air/gas mixture. The flame-shaping openings shape the mixture, resulting in flame having sides elongated transverse to the central axis. In the case of the flame-shaping openings 34, the circular flame from the outlet opening is elongated by the flame shaped by the flame-shaping openings.

When the flame length reducing member is used, the air/gas mixture from the outlet opening is diverted by the diverter portions. Depending on the horizontal or vertical application, an appropriate burner nozzle with one of the described burner nozzles is selected. The resultant diverted mixture is ignited by the igniter. This produces a flame having a length that may be reduced by about 17–50% from a conventional flame length of 12 inches and has a generally oval shape. The flame travels through an either vertically or horizontally oriented combustion tube depending upon the application, and the resultant heated gases are evenly distributed throughout the combustion tube in view of its corresponding elongated cross-sectional shape. The heated gases travel from the combustion tube into adjacent ductwork.

The heated air travels through the ductwork to the drum where it dries clothes rotating in the drum. The burner nozzle of the present invention results in temperatures which avoid overheating of the ductwork. These heat characteristics are due to the elongated and/or shortened flame.

Although the invention has been described in its preferred form with a certain degree of particularity, it will be understood that the present disclosure of preferred embodiments has been made only by way of example and that various changes may be resorted to without departing from the true spirit and scope of the invention as hereafter claimed.

What is claimed is:

1. A burner nozzle comprising:

a burner tube that extends along a central axis and has an inlet end for receiving a combustible mixture of gas and air, a body having a passageway in communication with said burner tube and having an elongated outlet end portion, at least one flame shaping opening disposed near said outlet end portion for releasing a mixture of said gas and air, at least one baffle that is integrally formed with said body and extends outwardly from said body near said outlet end portion for obstructing air flowing externally of said burner portion, and wherein at least one surface projects inwardly from said body and restricts said passageway for directing flow of said gas and said air.

2. The burner nozzle of claim 1 wherein at least one tab portion extends at an angle with respect to said central axis to obstruct at least a portion of the at least one said flame-shaping opening.

3. The burner nozzle of claim 2 wherein each said tab portion has a first section that extends from said body at an angle with respect to said central axis and a second section that extends from said first section substantially perpendicular to said central axis.

4. The burner nozzle of claim 2 comprising a first set of said tab portions and a second set of said tab portions that face said first set of said tab portions, wherein said tab portions in said first set and said tab portions in said second set extend from said body in an alternating arrangement relative to each other.

5. The burner nozzle of claim 1 comprising an end face disposed near the outlet end portion and having at least one angled or curved surface relative to said central axis, a plurality of said flame shaping openings being disposed in the at least one said surface.

6. The burner nozzle of claim 5 wherein said end face extends at an angle ranging from about 35 to 45 degrees with respect to said central axis.

7. A burner assembly comprising:

a combustion tube formed of sheet metal surrounding an interior region, said combustion tube comprising opposing sections each with a peripheral rib, the peripheral rib of one of said sections being constructed and arranged so as to overlie the peripheral rib of the other of said sections, said combustion tube being adapted to engage a heat receiving member;

a burner nozzle formed of sheet metal disposed in said interior region, said burner nozzle including wings which are trapped between each said peripheral rib, one said peripheral rib being folded over the other said peripheral rib, said burner nozzle comprising:

a burner tube that extends along a central axis and has an inlet end for receiving a combustible mixture of gas and air, a body having a passageway in communication with said burner tube and having an elongated end portion, said body increasing in size from said burner tube toward said elongated end portion, at least one flame shaping opening disposed near said end portion for releasing a mixture of said gas and air, and at least one surface that is angled or curved relative to said central axis, wherein the at least one said flame shaping opening is disposed near the at least one said surface, said central axis being generally perpendicular with and centrally located relative to the at least one said surface, and an igniter element fastened to said combustion tube and positioned so as to extend from an exterior of one of said sections to near said gas flow path, wherein the at least one said flame-shaping opening and the at least one said surface are constructed and arranged effective to elongate flame resulting from combustion of said mixture transverse to said central axis to produce efficient heat transfer between said flame and air inside said heat-receiving member.

8. A burner nozzle comprising:

a burner tube that extends along a central axis and has an inlet end for receiving a combustible mixture of gas and air and a width transverse to said central axis, a body having a passageway in communication with said burner tube and terminating in a generally rectangular outlet end portion that includes two generally parallel elongated edges that extend transverse to said central axis, said body increasing in size from said burner tube toward said outlet end portion, said outlet end portion comprising at least one surface that is angled or curved, wherein the at least one said surface includes a central imperforate region extending across said width of said burner tube near a midpoint between said elongated edges and generally parallel to said elongated edges, and;

at least one flame shaping opening disposed near the at least one said surface for releasing said combustible mixture of said gas and air;

wherein the at least one said flame-shaping operand and the at least one said surface are constructed and arranged effective to produce an elongated flame across an extent of said outlet and portion resulting from combustion of said mixture transverse to said central axis.

9. The burner of claim 8 wherein said imperforate region extends completely along a width of said elongated edges of said outlet end portion.

10. The burner of claim 8 wherein the at least one said flame shaping opening comprises a plurality of holes.

* * * * *